US006375299B1

(12) United States Patent
Foster et al.

(10) Patent No.: US 6,375,299 B1
(45) Date of Patent: Apr. 23, 2002

(54) FAULTY INK EJECTOR DETECTION IN AN INK JET PRINTER

(75) Inventors: James M. Foster, Jamul; John C. Love, San Diego, both of CA (US)

(73) Assignee: Encad, Inc., San Diego, CA (US)

( * ) Notice: Subject to any disclaimer, the term of this patent is extended or adjusted under 35 U.S.C. 154(b) by 0 days.

(21) Appl. No.: 09/184,466

(22) Filed: Nov. 2, 1998

(51) Int. Cl.[7] ..... B41J 29/393
(52) U.S. Cl. ..... 347/19
(58) Field of Search ..... 347/9, 10, 19, 347/92, 23

(56) References Cited

U.S. PATENT DOCUMENTS

| | | | | |
|---|---|---|---|---|
| 3,363,212 A | | 1/1968 | Joy | 338/174 |
| 3,747,120 A | | 7/1973 | Stemme | 347/70 |
| 3,946,398 A | | 3/1976 | Kyser et al. | 347/70 |
| 4,176,363 A | * | 11/1979 | Kasahara | 347/19 |
| 4,459,601 A | | 7/1984 | Howkins | 347/68 |
| 4,498,088 A | | 2/1985 | Kannayama | 347/92 |
| 4,686,539 A | | 8/1987 | Schmidle et al. | 347/15 |
| 4,973,981 A | * | 11/1990 | Bartky et al. | 347/19 |
| 5,049,898 A | * | 9/1991 | Arthur et al. | 347/19 |
| 5,500,657 A | | 3/1996 | Yauchi et al. | 347/9 |
| 5,576,743 A | | 11/1996 | Momose et al. | 347/11 |
| 5,631,675 A | * | 5/1997 | Futagawa | 347/10 |
| 6,086,190 A | * | 7/2000 | Schantz et al. | 347/81 |

* cited by examiner

*Primary Examiner*—John Barlow
*Assistant Examiner*—Julian D. Huffman
(74) *Attorney, Agent, or Firm*—Knobbe Martens Olson & Bear LLP

(57) ABSTRACT

A system and method for detecting a faulty piezoelectrically actuated ink ejector includes the piezoelectric element with an input signal, and sensing a response of the piezoelectric element to the input signal. Phase relationships and frequency dependent impedances may be analyzed and used to detect faulty ink ejectors. The detection circuit may include processing in the digital domain.

24 Claims, 9 Drawing Sheets

FAULTY INK EJECTOR DETECTION IN AN INK JET PRINTER

BACKGROUND OF THE INVENTION

1. Field of the Invention

The invention relates generally to ink jet printer technology. More particularly, the invention relates to ink jet printers which employ piezoelectric elements for ejecting ink.

2. Background of the Related Art

There are currently two major technologies used in drop-on-demand ink jet printing: thermal technology and piezoelectric technology. Most currently available ink jet printers use thermal methods to eject ink droplets out of a nozzle and onto a recording medium. In these methods, the actual ejection is initiated by heating the ink adjacent to the nozzle with a thin film resistor to create a bubble which forces a drop of ink out of the nozzle. Some recently introduced ink jet printers employ piezoelectric technology to achieve the same end of ejecting ink onto the recording medium.

Piezoelectricity refers to the deformation of a crystalline material when subjected to an electrical potential. Instead of using heat to eject the ink, these printers employ piezoelectric deformation to reduce the volume of a small ink reservoir, thereby ejecting a droplet of ink from the reservoir. In some piezoelectric ink jet print heads, a piezoelectric element is actuated so as to exert mechanical pressure on a membrane laying against the ink channel. When a very short electrical pulse is applied to the piezoelectric element, it may expand, contract, bend, or otherwse deform. The deformation of the piezoelectric element forces the ink out of the ink channel onto the recording medium. The expansion and contraction occurs at high speed and produces high pressures inside the ink reservoir, making an ink droplet eject from the nozzle and onto the recording medium.

In order to enhance printing resolution, ink jet printers often use several hundred adjacent nozzles, each having a diameter of less than 50 micrometers. The use of smaller ink chambers and finer nozzles creates a commonly recurring problem in ink jet printers. The ink channels of these printers may contain non-ink material such as air bubbles. Air can be introduced if the ink channels are run completely out of ink during use, or bubbles in the ink can become trapped near the piezoelectric actuators and nozzles over time. The presence of excess air in the channel causes the ink ejection mechanism to malfunction, thereby affecting the quality and resolution of the printed material. Such degradation in print quality can seriously undermine the effective utility of ink jet printers.

Several attempts have been made to detect the presence of air bubbles in ink channels with varying degrees of detectability. One attempt involved activating the piezoelectric element simultaneously with a simulation capacitor, and comparing the responses to the pulse activation. This technique is described in detail in U.S. Pat. No. 4,498,088 to Kanamaya. Another technique actuates the piezoelectric element with a normal ink ejection pulse, and detects a voltage overshoot which may develop across the actuated piezoelectric element. This technique is described in U.S. Pat. No. 5,500,657 to Yauchi et al. The Kanamaya and Yauchi et al. references are hereby incorporated by reference in their entireties.

The Kanamaya and Yauchi techniques require fairly complex analog actuation and detection circuits. Furthermore, they attempt to detect small perturbations in relatively large actuation signals, thus increasing the chances of erroneous evaluation of an ink channel.

SUMMARY OF THE INVENTION

The present invention provides an improvement over the prior art by simplifying the dedicated detection circuitry required for ink ejector evaluation. Advantageously, in some systems in accordance with the invention, computational hardware already present in the ink jet printer is used to perform ink ejector analysis, thereby minimizing costs associated with faulty jet detection systems.

In one embodiment of the invention, a fault detection circuit for a piezoelectric ink jet printer comprises a driver circuit coupled to at least one piezoelectrically actuated ink ejector for applying a test signal to the ejector and a pre-processing circuit for monitoring, processing, and digitizing a response of the ejector to the test signal. The fault detection circuit also includes digital signal processing means for receiving an output from the pre-processing circuit and for analyzing a frequency dependent impedance of the ink ejector. As the impedance may shift with the presence of air bubbles in the channel, faulty ink ejectors may be detected.

In another embodiment, an ink jet printer incorporating fault detection comprises a first drive circuit coupled to a plurality of ink ejectors so as to control ink ejection therefrom during normal printing operations as well as a second drive circuit periodically coupled through a resistor to a selected one of the plurality of ink ejectors. The second drive circuit is configured to apply a test signal through the resistor to the selected ink ejector. The printer also comprises a fault detection circuit having an input connected to at least one side of the resistor; wherein an electrical signal present there is detected by the fault detection circuit, and wherein characteristics of the detected electrical signal are indicative of an operational status of the selected ink ejector. It can be appreciated that in these embodiments, faulty ink ejection channels may be accurately detected using a minimum of dedicated circuitry.

Methods of detecting faulty ink ejectors are also provided. In one embodiment, an ink jet printer system has a plurality of ink jet channels (IJC), each IJC including a piezoelectric element. A method of detecting faulty IJCs includes driving the piezoelectric element with an input voltage signal; and sensing a phase difference between the input voltage signal and a resulting current through the piezoelectric element. In another embodiment, a method of detecting faulty IJCs comprises determining the impedance of the piezoelectric element at at least one frequency band. The above described methods take advantage of variations in a piezoelectric ink ejectors response to selected test signals, reducing the complexity of test driver and detection circuitry.

DETAILED DESCRIPTION OF THE PREFERRED EMBODIMENT

Preferred embodiments of the present invention will now be described with reference to the accompanying Figures, wherein like numerals refer to like elements throughout. The terminology used in the description presented herein is not intended to be interpreted in any limited or restrictive manner, simply because it is being utilized in conjunction wit a detailed description of certain specific preferred embodiments of the present invention.

Figure 1A:
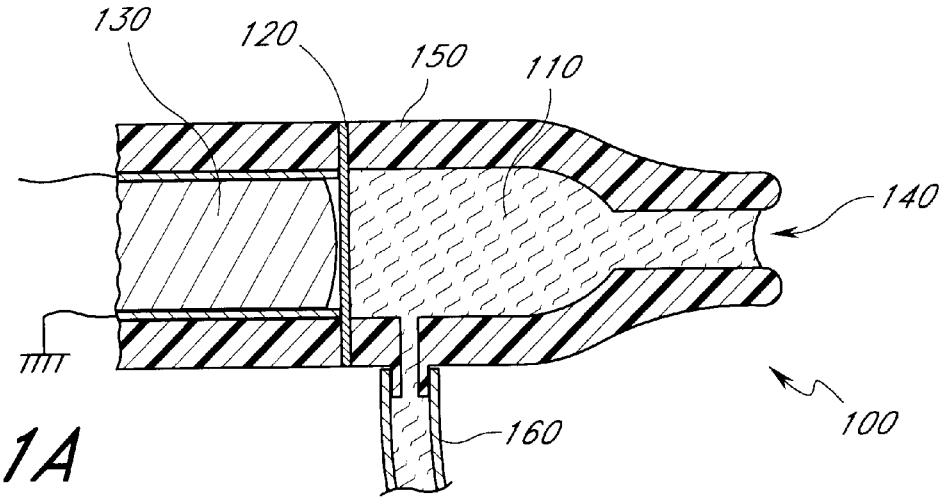
FIG. 1A is a cross-section of an ink jet head primed with normal ink liquid.

Many different methods of fabricating drop-on-demand piezoelectric ink jet printheads have been devised. As discussed above, the general principle involves reducing the volume of an ink chamber so as to force ink out of a nozzle in the ink chamber and onto a piece of paper or other recording medium. Although the invention has application to many different types of piezoelectric ink jet methods, one example of a configuration suitable for producing such ink chamber volume reductions is illustrated in FIGS. 1A through 2B. In FIG. 1A, a cross-section of an ink jet head primed normally with liquid ink is illustrated. As shown in this Figure, the ink jet head 100 comprises an ink jet channel (IJC) 110, a piezoelectric element 130, and a deformable membrane 120 placed therebetween. A nozzle 140 at the tip of the ink jet head 100 is provided for ink ejection onto the media. The IJC 110 is surrounded by IJC walls 150. Ink liquid is supplied into the IJC 110 via an ink supply tube (IST) 160.

Figure 1B:
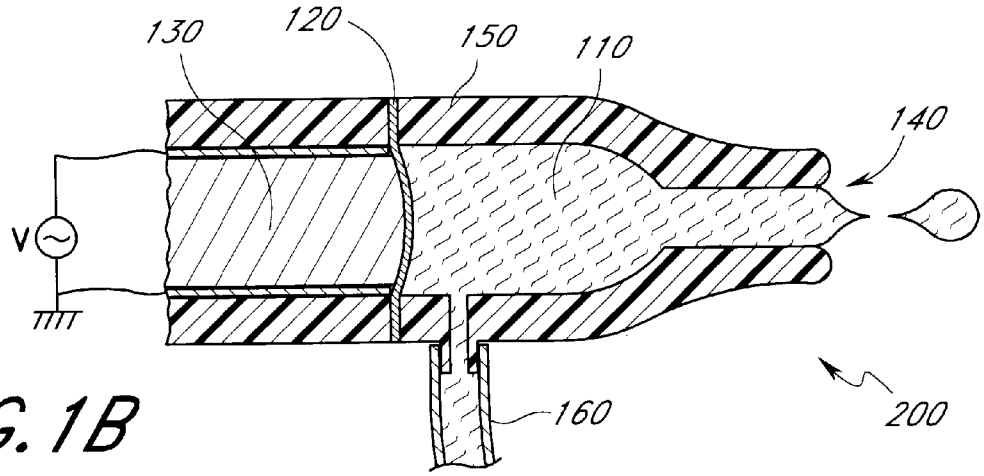
FIG. 1B is a cross-section of the ink jet head of FIG. 1A under normal operation.

FIG. 1B is a cross-section of the ink jet head of FIG. 1A under normal operation. Upon applying a voltage pulse to the piezoelectric element 130, the piezoelectric element 130 develops a mechanical strain and expands. This mechanical strain causes the deformable membrane 120 to convexly extend into the IJC 110, thereby forcing the ink liquid to eject from the IJC 110 through the nozzle 140. After expansion, the piezoelectric element 130 contracts, drawing ink up the ink supply tube 160, replenishing the expelled ink droplet. In on alternative embodiment, the piezoelectric crystal may draw ink into the IJC 110 by first retracting, and then may elongate back to normal size to eject ink from the IJC 110. Although FIGS. 1 and 2 specifically illustrate the first described "fire before fill" technique, both techniques are well known to those of skill in the art, and the invention is applicable to these and other ink ejection mechanisms.

Figure 2A:
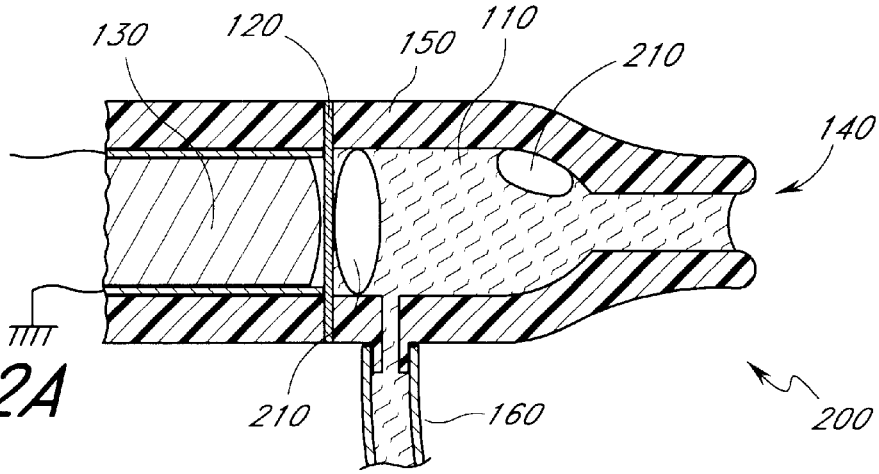
FIG. 2A is a cross-section of an ink jet head primed with ink liquid containing air bubbles.

When the IJC 110 contains air bubbles, the ejection mechanism may not function properly. FIG. 2A is a cross-section of an ink jet head filled with ink containing air bubbles. As shown in FIG. 2A, the ink jet head 200 is structurally and functionally identical to the ink jet head 100 of FIGS. 1A and 1B. However, air bubbles 210 are present in the ink liquid in the IJC 110. The presence of air bubbles 210 in the IJC 110 may be due to several factors. Air may be introduced when replacing ink reservoirs external to the print head, or may result from continuing to print after the attached ink reservoir has run dry. Because adhesion forces between air bubbles 210 and the IJC walls 150 are often greater than flow forces associated with the flow of ink liquid through the IJC 110, once air bubbles have been introduced into the IJC 110, they may be difficult or impossible to remove.

Figure 2B:
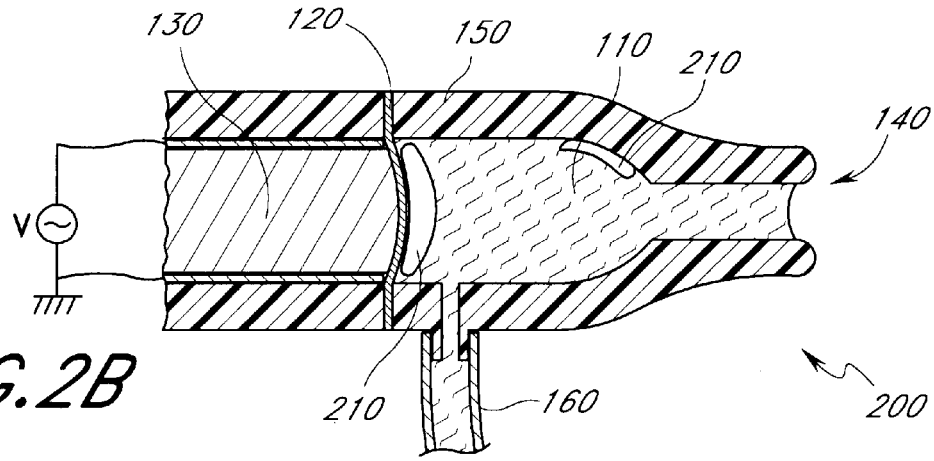
FIG. 2B is a cross-section of the ink jet head of FIG. 2A under faulty operation.

The presence of air bubbles 210 in the IJC 110 interferes with, and often prevents, the ejection of ink through the nozzle 140. FIG. 2B is a cross-section of the ink jet head of FIG. 2A under faulty operation. As shown in FIG. 2B, the IJC channel 110 contains one or more air bubbles 210. A signal generator 220 is connected to the piezoelectric element 130 to provide actuation pulses to the piezoelectric element 130. As discussed above, the piezoelectric element 130 generates a mechanical strain onto the deformable membrane 120 causing it to convexly expand. The expansion of the deformable membrane 120 increases the pressure in the IJC 110. However, instead of ejecting ink, the increased pressure in the IJC 110 is absorbed by the air bubbles 210 causing no ink to eject from the nozzle 140.

The invention provides a system and method for detecting the presence of such air bubbles 210. A typical ink jet printer may include, for example 50–400 ink jet channels and associated nozzles. Additionally, the ink jet print head may include several spare ink jet channels. The system detects and identifies faulty ink jet channels. Once detected, the printing system may perform one or more of a variety of functions, including notifying the operator of the fault condition, running a service routine on the printhead, or replacing faulty ink jet channels with one or more spare ink jet channels.

Figure 3:
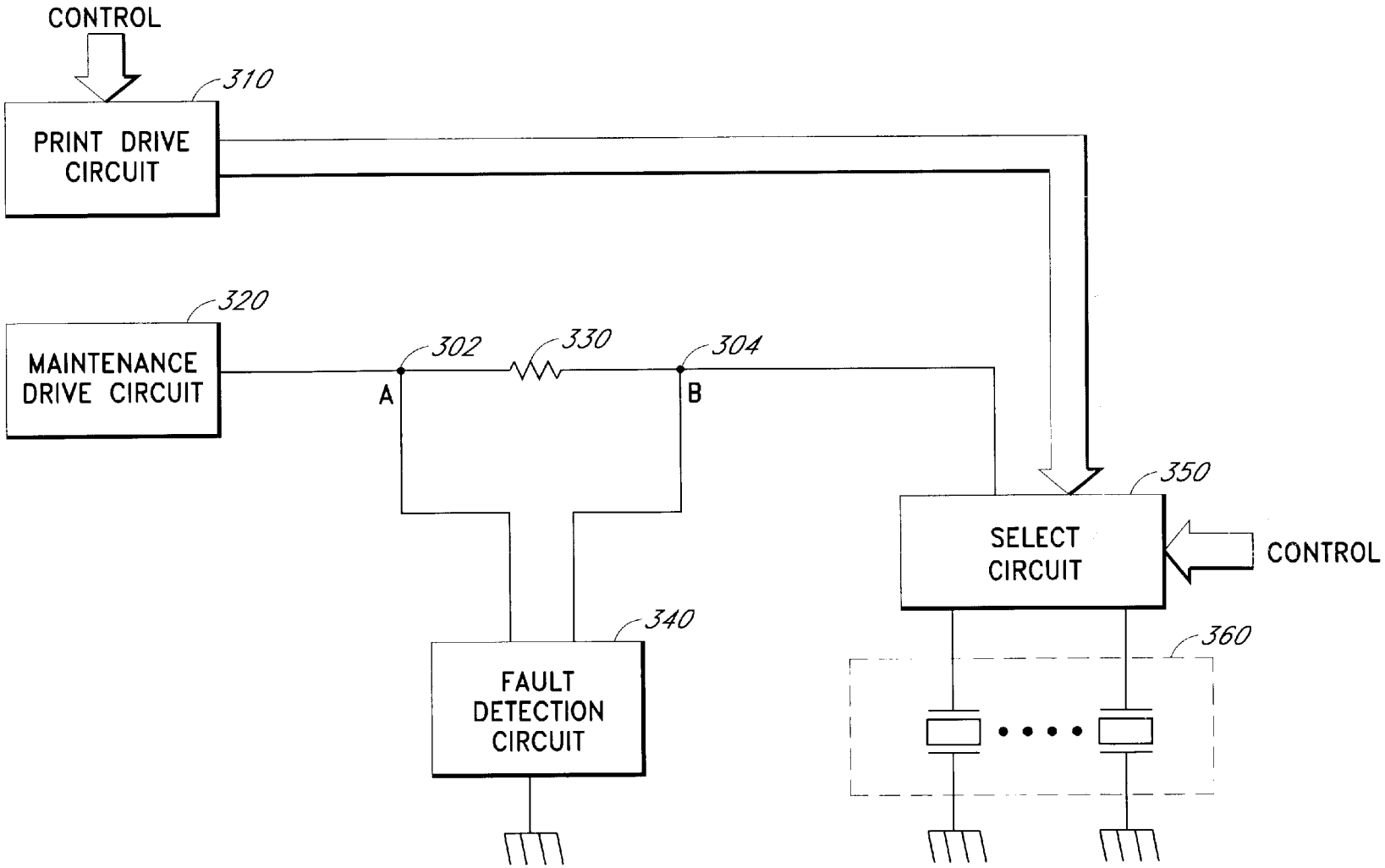
FIG. 3 is a schematic diagram of one embodiment of the detection system employed in the diagnosis of faulty ink jet channels.

FIG. 3 is a schematic diagram of one embodiment of the detection system employed in the diagnosis of faulty ink jet channels. As shown in FIG. 3, a print drive circuit (PDC) 310 is connected to a select circuit (SC) 350. A maintenance drive circuit (MDC) 320 is connected to an impedance 330, which may be inductive, capacitive, or resistive, and which is connected to the SC 350. The embodiment illustrated in FIG. 3 shows a resistor as the impedance 330. The resistance used in this embodiment may vary widely, and certain ranges may be more appropriate to certain piezoelectric printhead designs. Resistance values of 100 kohms to 200 kohms have been successful in some embodiments. It will be appreciated that a resistor is advantageous in that its impedance is not frequency dependent. The SC 350 is connected to one or more piezoelectric elements 360, each contained in an ink jet print head. A fault detection circuit (FDC) 340 is connected to one or both sides of the resistor 330 to detect abnormalities in the operation of the piezoelectric elements 360 as will be explained further below.

The PDC 310 generates piezoelectric actuation signals in response to print data generated by a host computer, such as a printer server (not shown in this figure). During printing operations, the print head passes back and forth across the media, and the piezoelectric elements are selectively actuated, one or more at a time, to deliver ink droplets to the media by the signals received from the PDC 310. During periods when the piezoelectric elements 360 are not being utilized to place ink droplets on the recording medium, such as prior to beginning a print, or even during a print at those times between passes across the media, the piezoelectric elements 360 may be individually connected through the SC 350 to the MDC 120. The SC 350 connects the MDC 320 to a given piezoelectric element 360 in order to diagnose malfunctions or faulty ink jet channels. The SC 350 is thus configured to periodically connect the MDC 320 to individual ones of the piezoelectric elements 360.

In one advantageous embodiment, the SC 350 sequentially selects piezoelectric elements 360 for testing. As mentioned above, these selections advantageously occur when the print head is not being used for printing. The test signals which the MDC 320 applies to a piezoelectric element may vary widely in their characteristics. In some embodiments, the signal is a constant amplitude and constant frequency sine wave. In other embodiments, the frequency of an applied sine wave is swept from a low initial frequency to a high ending frequency. In still other embodiments, one or more square waves or other time limited pulse shapes having a range of frequency components may be used. The amplitude, duration, and frequency applied by the MDC 320 will vary depending on the nature of the print head being tested and the desired method of fault detection incorporated into the FDC 340. The amplitude of the maintenance drive signal is preferably below the amplitude required for droplet ejection. Furthermore, the signal preferably includes a high energy content in a frequency range around the resonant frequency of the piezoelectric element being tested. The signal will be applied for the duration required by the FDC 340 to make a determination as to the status of the piezoelectric element being tested. The FDC 340 may receive as an input both the voltage signals at points A 302 ($V_A$) and B 304 ($V_B$) with respect to a reference voltage, e.g., ground, as shown in FIG. 4A, or may utilize a measurement of only the voltage at point B 304 relative to ground, as shown in FIG. 4B.

Figure 4A:
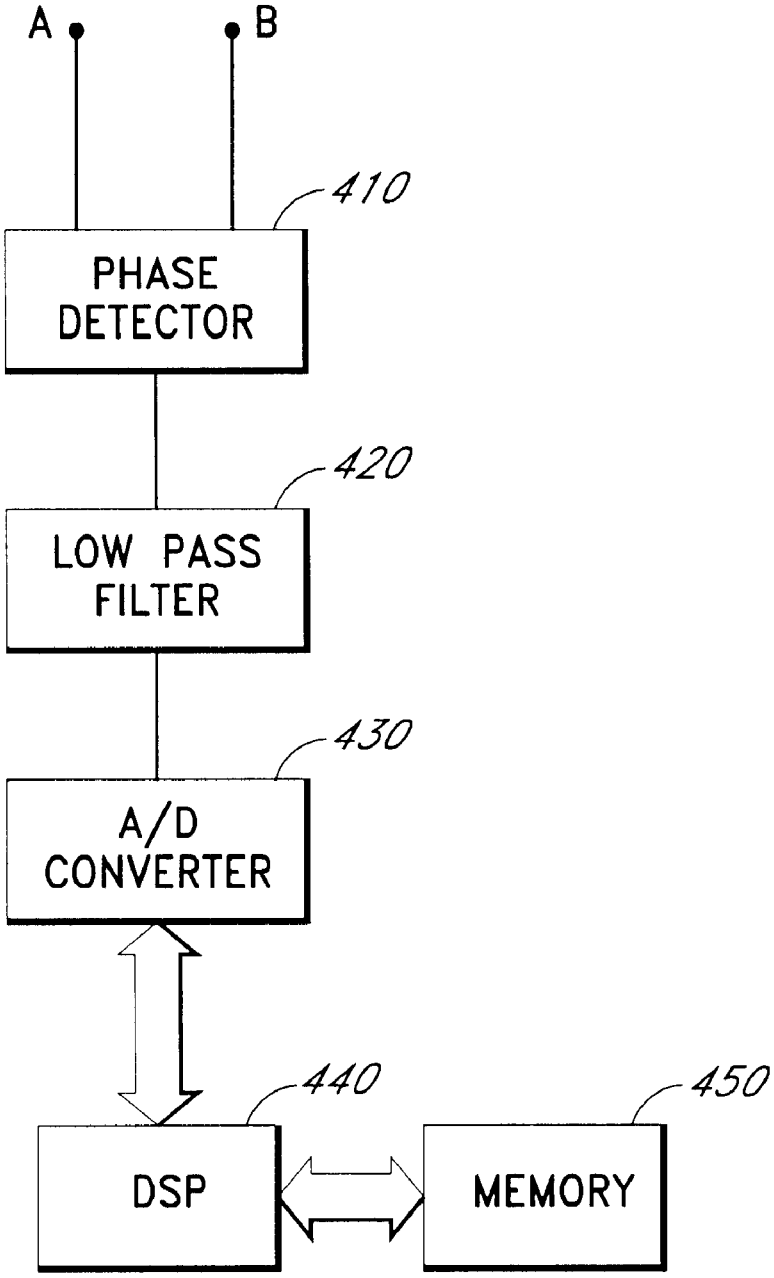
FIG. 4A is a functional block diagram of one embodiment of a fault detection circuit employed in the detection system of FIG. 3.
Figure 4B:
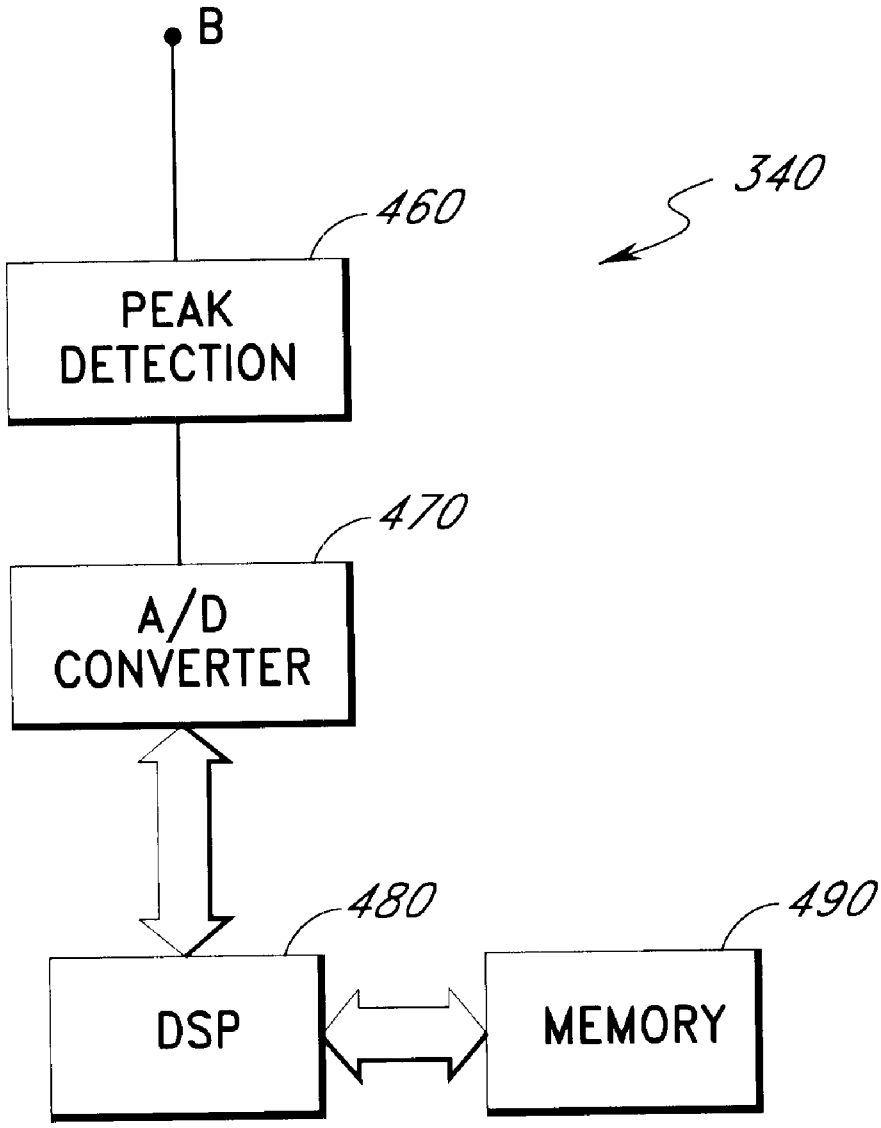
FIG. 4B is a functional block diagram of another embodiment of a fault detection circuit employed in the detection system of FIG. 3.

In one embodiment, illustrated in FIG. 4A, the FDC 340 evaluates the signals received from points A and B by routing them to a phase detector 410 to compare the phase of $V_A$ to the phase of $V_B$ to determine the presence or absence of air bubbles in the IJC 110. The phase detector 410 may be an analog multiplier which is commonly referred to as a four-quadrant multiplier, or any other type of phase detector (analog or digital) which are well known in the art. In this embodiment, the applied signal is advantageously a continuous sine wave having a frequency at approximately the resonant frequency of the piezoelectric element/ink channel being tested. For purposes of explanation, the piezoelectric element and the chamber it is coupled to can be considered a "black box" impedance between node 304 (FIG. 3) and ground. It has been observed that if air bubbles are not present in the IJC 110, the apparent or effective capacitance of the piezoelectric element being tested is small, and the current through the resistor 330 of FIG. 3 is in phase with the drive signal voltage at point A 302. Hence, the phase difference between the voltage signals $V_A$ and $V_B$ is small or zero. On the other hand, if air bubbles are present in the IJC 110, the response of the piezoelectric element is altered so as to increase the effective capacitive characteristics of the piezoelectric element being tested. The piezoelectric element no longer appears essentially resistive in nature, and the phase difference between the voltage signals $V_A$ and $V_B$ is detectable and quantifiable.

As illustrated in FIG. 4A, the FDC 340 may additionally comprise a low pass filter (LPF) 420 and an analog-digital converter (ADC) 430 connected to receive, filter, and digitize the output of phase detector 410. The LPF 420 is a low pass filter which excludes high frequency components typically present in analog phase detection circuits. The ADC 430 converts the filtered phase measurement from analog to digital form for further processing. A digital signal processor (DSP) 440, and a memory 450 are further connected to receive the digitized output from the ADC 430. The DSP 440 is programmed to compare the phase difference measured for a given piezoelectric element with a threshold value to determine whether or not the piezoelectric element being tested is faulty.

Although the circuit of FIG. 4A illustrates analog phase detection and filtering, it can be appreciated that the signals at point A 302 and point B 304 could be digitized directly, and all signal processing required to perform phase analysis could be performed by the DSP 440 in the digital domain. In this case, the phase detector and filter functions would be implemented in the software running on the DSP 440. The DSP 440 advantageously comprises a single chip processing circuit, such as are widely used throughout the electronics industry and which are commercially available from Texas Instruments, Lucent, Motorola, and others.

In some cases, one or more of the piezoelectric elements 360 may exhibit effective capacitive characteristics even when air bubbles are not present in the IJC 110. Therefore, there may be a current to voltage phase offset even for a properly functioning channel. Parameters representative of this phase offset for such piezoelectric elements having a quantifiable effective capacitance at the maintenance drive signal frequency may be stored in the memory 450. The initial phase offset values are obtained under known conditions and, particularly, when air bubbles are absent from the respective IJCs 110. In testing a piezoelectric element, the FDC 340 compares the phase offset stored in the memory 450 which is associated with the channel being tested to determine if an increased phase offset indicative of a faulty channel is present.

Figure 5:
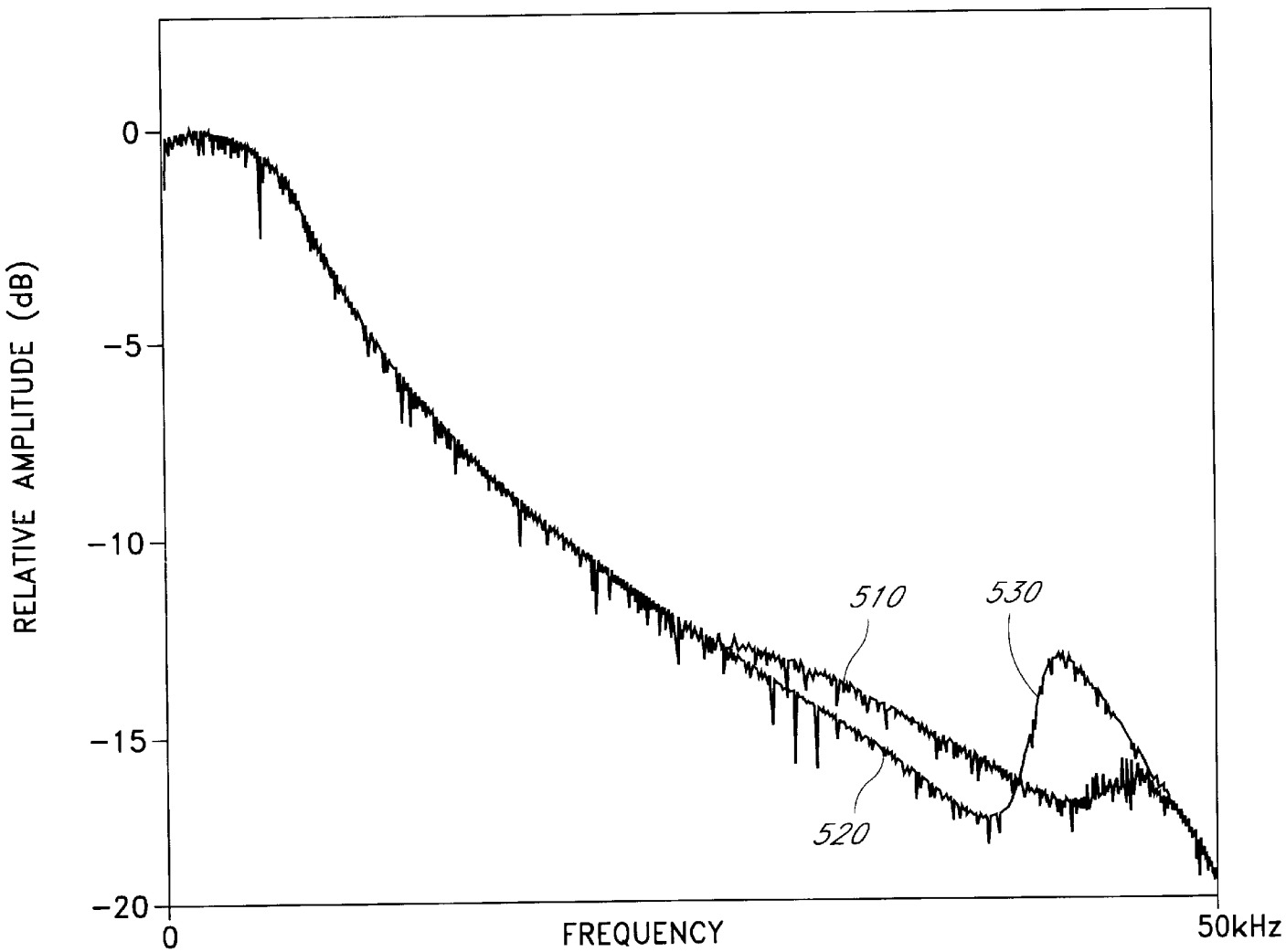
FIG. 5 is a plot of signal amplitude measured across a piezoelectric element as a function of frequency.

FIG. 4B illustrates a second embodiment of the FDC 340 of FIG. 3. In this embodiment, the FDC 340 only utilizes the voltage present at point B 304 between the resistor 330 and the piezoelectric element 360 being tested. In this embodiment, the signal level present at this node may be used as an indication of a faulty IJC 110 as the response of the piezoelectric element at selected excitation frequencies may change when air is present in the channel. In some embodiments, near the resonant frequency of the piezoelectric element/ink channel, the signal level at this node 304 may increase when air bubbles are present in the IJC 100. Without being limited to any particular theory of operation, it is suspected that the increased signal level is due to a decrease in fluidic damping by fluid in the IJC 110. When there is no air in the chamber, the fluid damps the response of the piezoelectric element at the resonant frequency. When there is excessive air in the chamber, the response of the piezoelectric element is not as damped, creating a hump in the frequency response curve as illustrated in FIG. 5 and described in more detail below.

To detect this increase, the FDC 340 includes a peak or RMS detection circuit 460 having an output connected to an analog to digital converter (ADC) 470. As with the embodiment illustrated in FIG. 4A, the output of the ADC 470 is routed to a digital signal processor (DSP) 480 and memory 490. The signal level present at node B 304 is thus received by the DSP 480 and compared to a threshold to determine whether or not the IJC 110 being tested is faulty. As with the embodiment of FIG. 4A, the memory may store a table of parameters indicative of signal levels associated with one or more of the piezoelectric elements of the print head when they are functioning properly. In this case, the DSP 480 may compare the received signal level with the parameter previously stored in the memory 490.

Figure 4C:
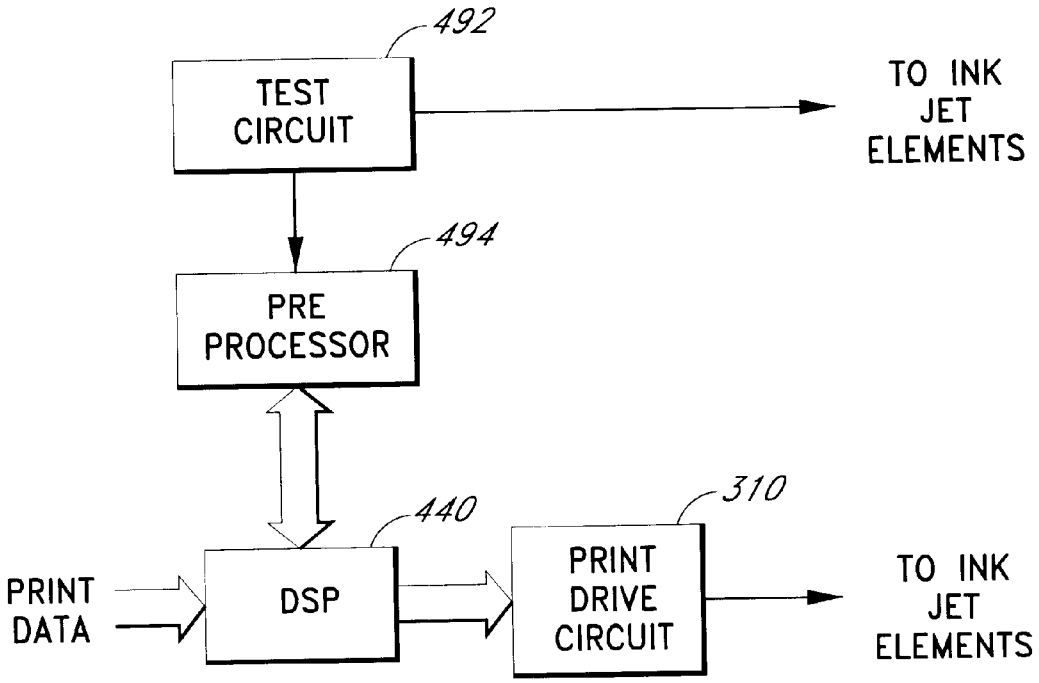
FIG. 4C is a functional block diagram illustrating signal processing circuitry performing both print control and fault detection.

As an ink jet printer typically includes a digital signal processing circuit to perform its normal printing operations, the implementation of the invention can be performed using processing capacity already present in the printer, thus minimizing costs associated with faulty jet detection. This feature is illustrated in FIG. 4C. In this Figure, the test circuit 492 provides an input to a preprocessor circuit 494. Example test and pre-processor circuits are illustrated and discussed with reference to FIGS. 4A and 4B, As discussed with reference to these Figures, the test circuit 492 may include a signal generator and a series impedance, and the pre-processor 494 may include filters, A/D converters, peak detectors, phase detectors, etc.

Referring again to FIG. 4C, the DSP 440 may be used to receive print data and to control the print drive circuit 310 during normal printing operations in addition to receiving an input from the pre-processor 494. As mentioned above, the testing may be performed during those periods when the processing circuit 440 is not being used to process print data such as prior to beginning a print job or in between passes across the media. It will be appreciated that the fault detection methods described herein may thus be implemented via appropriate programming of the processor circuit 440 in the ink jet printer. The software implementing these methods will generally be stored in a programmable storage device in the printer, such as a ROM or EEPROM, which may be integral to or separate from the processor 440 itself.

As an example of the signal level differences produced by the presence of air bubbles in an IJC 110, FIG. 5 provides plots of the measured potential at point B 304 of FIG. 3 as a function of the frequency of a continuous sine wave output from the MDC 320 for both a functioning channel and a channel containing a significant amount of air. In this Figure, the horizontal axis represents the frequency of voltage signals applied to the piezoelectric element 360 selected by the SC 350. The y-axis represents the amplitude ($A_r$) in dB of the voltage signals ($V_B$) measured across the piezoelectric element 360, i.e., at point B 304 (FIG. 3) relative to the applied voltage of the MDC 320. In producing this plot, a piezoelectric element and IJC 110 of configuration similar to that illustrated in FIGS. 1 and 2 was used which had a resonant frequency of approximately 41.5 kHz.

The first curve 510 represents the variation in $A_r$, for a piezoelectric element without air bubbles, as a function of frequency of $V_{MDC}$. The second curve 520 represents the variation in the relative amplitude $A_r'$, for a piezoelectric element with air bubbles, as a function of frequency of $V_{MDC}$. The two curves begin to diverge at approximately 28 kHz, with the deviation becoming most significant (between 3–4 dB) and most detectable at around the resonant frequency of approximately 41.5 kHz. Of course, different styles of piezoelectric print head will have different response curves and will be resonant at different frequencies. It will be appreciated that the embodiment shown in FIG. 5 is one illustrative example.

It will be appreciated by those of skill in the art that several alternative schemes may be used to detect this difference in response with and without air in the chamber. In one embodiment, the MDC 320 supplies a sine wave signal having a fixed frequency at approximately the resonant frequency of the IJC 110. The signal level at point B. 304 is compared to a threshold expected signal level, and the IJC 110 may be detected as faulty if the signal level exceeds the threshold. Alternatively, the frequency output by the MDC 320 could be swept through a range of frequencies, and a faulty IJC 110 may be detected by detecting the region of large positive slope 530 present in the response curve 520 of an IJC 110 which contains excess air. The response at point 13 to a square wave, chirp, or other time limited waveform containing a range of frequency components may also be detected at point B, and may be used to characterize an IJC 110 as good or faulty.

In analogy with the embodiment described above with reference to FIG. 4A, the signal level at point B for each piezoelectric element may be recorded in the memory unit 490 during printer manufacture before regular operation. The FDC 340 may determine the presence of faulty ink jet channel by measuring the signal level at point B 304 for a piezoelectric element being tested and comparing this with the expected response measured during manufacture when the channel was known to be functioning properly. If the FDC 340 detects a deviation such as shown in FIG. 5, then the piezoelectric element being tested is considered faulty.

Figure 6:
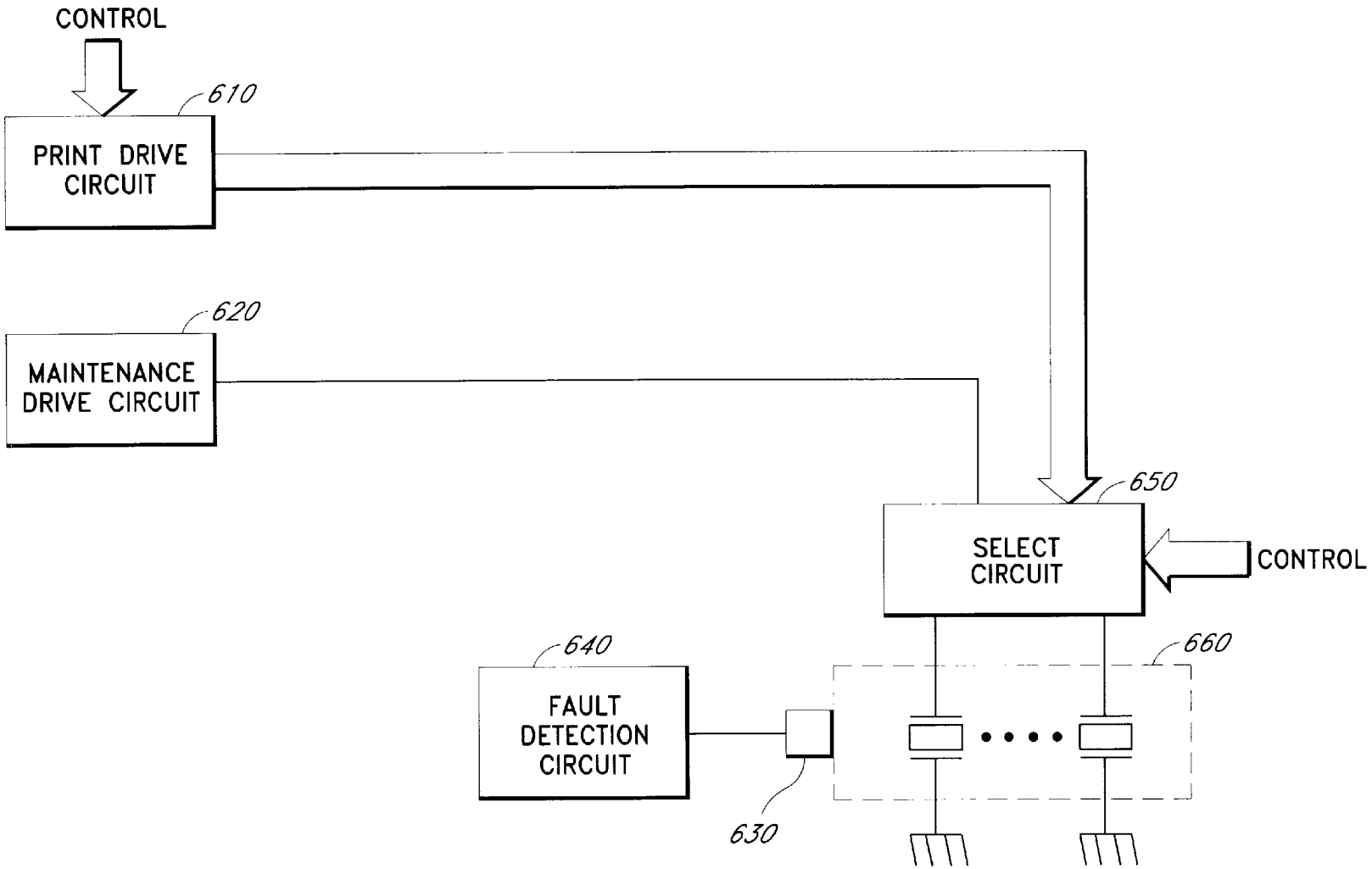
FIG. 6 is a schematic diagram of another embodiment of a detection system employed in the diagnosis of faulty ink jet channels.

FIG. 6 is a schematic diagram of another embodiment of a detection system employed in the diagnosis of faulty ink jet channels. As shown in FIG. 6, a print drive circuit (PDC) 610 is connected to a select circuit (SC) 650. A maintenance drive circuit (MDC) 620 is connected to the SC 650. The SC 650 is connected to one or more piezoelectric elements 660, each contained in an ink jet head. In the embodiment of FIG. 6, these items may be essentially identical to the ones shown and described with reference to FIG. 3 above.

In the embodiment of FIG. 6, however, a vibration transducer 630 is attached to the ink jet print head. Suitable vibration transducers are known in the art, and typically comprise an accelerometer which converts mechanical vibrations into an electrical signal. A fault detection circuit (FDC) 640 is connected to the vibration transducer 630 to detect abnormalities in the operation of the piezoelectric elements 660. As described above, the SC 650 selects the PDC 610 under normal printing operation ("normal mode") to activate printing by the ink jet nozzles. In the diagnostic mode, the SC 650 selects one piezoelectric element to be tested. The MDC 620 applies voltage signals having a predetermined amplitude, duration, and frequency which may be of insufficient intensity to eject ink from the channel, but which elicit a vibratory response in the print head. In many embodiments, it is desirable that the frequency of the test signals be substantially close to the resonant frequency of the piezoelectric element being tested. It will be appreciated, however, that a wide variety of test signals could be utilized including square pulses, frequency swept signals, etc.

The FDC 640 detects and measures the vibration signals generated by the piezoelectric elements 660 in response to the voltage signals driving the one piezoelectric element being tested. The energy content of the vibrations in different frequency bands may be significantly different when excess air is present in the channel being tested. Thus, in analogy with the above described electrical signal monitoring, the FDC 640 compares the vibration signals to already known, and previously recorded, vibration signals of the piezoelectric elements 660 when they are known to be functioning properly during printer manufacture. If the vibration signals show differences associated with air bubble presence or other detectable faults, then the FDC 640 determines that the operation of the channel piezoelectric element being tested is faulty.

Figure 7:
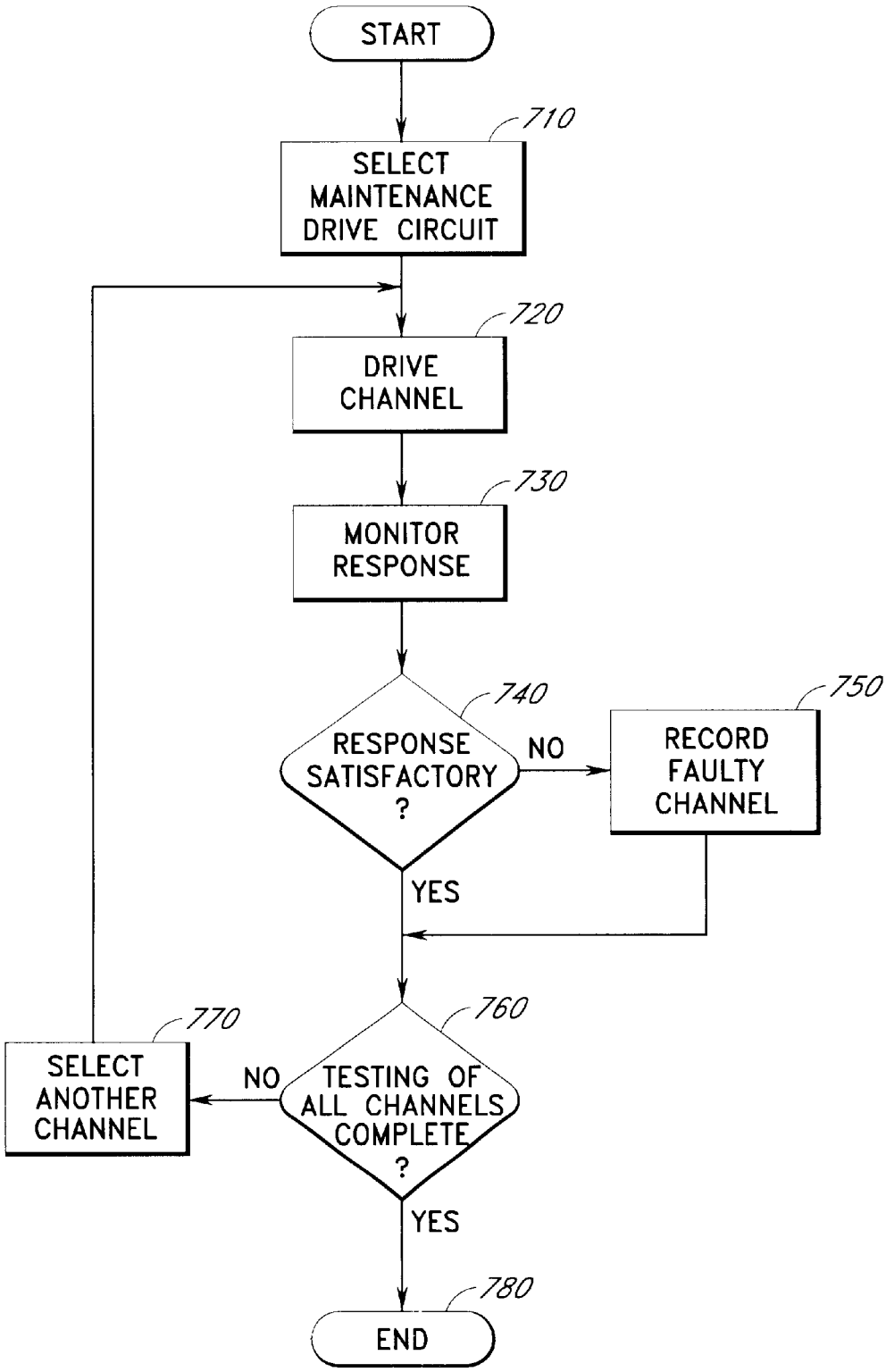
FIG. 7 is a flow chart of decisional steps employed in a fault detection system according to one embodiment of the present invention.

FIG. 7 is a flow chart of the steps employed by a fault detection system in accordance with the present invention.

As shown in FIG. 7, at step 710, the SC 350 (FIG. 3) selects the MDC 320 to drive a particular piezoelectric element ("channel") for testing. At step 720, the MDC 320 drives the channel being tested with the desired signal. As noted above, the test signals preferably include a large component at or near the resonant frequency of the piezoelectric element/ink channel being tested. At step 730, the FDC 340 monitors the response of the channel. At step 740, the FDC 340 determines if the response by the channel being tested is satisfactory. This may advantageously be performed by comparing the measured response to an appropriate expected value which was stored when the ink jet channel being tested was known to be functioning properly. If the channel response is not satisfactory, then at step 750, the FDC 340 records the channel as faulty in the memory unit 450, 490. Next, at step 760, the FDC determines if more channels are to be tested. If no channels remain to be tested, then the process terminates at step 780. If it is desirable to test another channel then, at step 770, the SC 350 selects another channel for testing, and the process loops back to step 720 to analyze an additional ink jet channel.

In some embodiments, the procedure illustrated in FIG. 7 is performed on all of the ink jet channels of the head prior to beginning each print job. In other embodiments, the channels are sequentially tested during print jobs as well by performing channel tests at those times when the ink jet print head is in between passes across the media being printed.

In view of the foregoing, it will be appreciated that the invention overcomes the long-standing need for a system and method for detecting faulty ink ejection channels without the disadvantages of inaccurate detection criteria, or obtaining measurements which may be susceptible to error. The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A piezoelectric ink jet printer incorporating ink ejector fault detection, said ink jet printer comprising:

an ink jet print head comprising a plurality of ink ejectors, wherein each of said plurality of ink ejectors is piezoelectrically actuated so as to eject droplets of ink in accordance with print data received from a host computer system;

a first drive circuit coupled to said host computer system and to said plurality of ink ejectors so as to control ink ejection therefrom during normal printing operations;

a second drive circuit periodically coupled through a resistor to a selected one of said plurality of ink ejectors, wherein said second drive circuit is configured to apply a test signal through said resistor to said selected ink ejector during periods when said ink ejector is not being utilized for printing operations by said first drive circuit;

a fault detection circuit having an input connected to at least one side of said resistor; wherein an electrical signal present at said at least one side of said resistor is detected by said fault detection circuit simultaneously with the application of the test signal, and wherein characteristics of said electrical signal are indicative of an operational status of said selected ink ejector, wherein said fault detection circuit comprises an analog to digital converter having as an input an analog signal derived from said electrical signal present at said at least one side of said resistor and having as an output a digital representation of said analog signal, and digital signal processor coupled to said output of said analog to digital converter for analyzing said digital representation of said analog signal and detecting faulty ink ejectors therefrom.

2. The ink jet printer of claim 1, wherein said second drive circuit is configured to apply a test signal comprising a sine wave having a frequency at approximately a resonant frequency of said selected ink ejector.

3. The ink jet printer of claim 1, additionally comprising a memory coupled to said digital signal processor, wherein said digital signal processor is configured to retrieve one or more parameters stored in said memory, and to compare said one or more parameters to said digital representation of said analog signal.

4. The ink jet printer of claim 1, wherein said fault detection circuit comprises a phase detector coupled to both sides of said resistor.

5. An ink jet printer incorporating fault detection comprising:

a first drive circuit coupled to a plurality of ink ejectors go as to control ink ejection therefrom during normal printing operations;

a second drive circuit periodically coupled through an impedance to a selected one of said plurality of ink ejectors, wherein said second drive circuit is configured to apply a test signal through said impedance to said selected ink ejector;

a fault detection circuit having an input connected to at least one side of said impedance; wherein an electrical signal present at said at least one side of said impedance is detected by said fault detection circuit simultaneously with the application of the test signal, and wherein characteristics of said electrical signal are indicative of an operational status of said selected ink ejector.

6. A fault detection circuit for a piezoelectric ink jet printer comprising:

a driver circuit coupled to at least one piezoelectrically actuated ink ejector, wherein said driver circuit has at least one output comprising an analog electrical signal indicative of an operational status of said at least one piezoelectrically actuated ink ejector, wherein the driver circuit produces the analog electrical signal simultaneously with an application of a test signal applied to the at lease one piezoelectrically actuated in ejector;

an analog to digital converter having as an input said analog electrical signal and having as an output a digital representation of said analog electrical signal; and a digital signal processor, coupled to said analog to digital converter, for receiving and analyzing said digital representation of said analog electrical signal whereby faulty piezoelectrically actuated ink ejectors are detected.

7. The fault detection circuit of claim 6, additionally comprising a memory coupled to said digital signal processor, said memory storing at least one parameter indicative of proper operational status of said at least one piezoelectrically actuated ink ejector.

8. The fault detection circuit of claim 7, wherein said digital signal processor is configured to compare a parameter derived from said analog electrical signal with said at least one parameter indicative of proper operational status of said at least one piezoelectrically actuated ink ejector.

9. In an ink jet printer comprising a plurality of piezoelectrically actuated ink ejectors and a processor, a programmed storage device storing instructions causing said processor to perform a method comprising:

receiving print data;

processing said print data so as to initiate piezoelectric actuation signals so as to perform drop on demand ink jet printing while said plurality of ink ejectors pass over a print media;

periodically receiving one or more test signals from an ink ejector test circuit when said plurality of ink ejectors are not being utilized for said drop on demand ink jet printing;

simultaneously comparing said test signals to a threshold while the test signals are being received; and detecting faulty ink ejectors based at least in part on a result of said comparing.

10. The programmed storage device of claim 9, wherein said threshold is defined at least in part by a parameter stored in a memory in said ink jet printer, said parameter being representative of a properly functioning ink ejector.

11. In an ink jet printer system having a plurality of ink jet channels (IJC), each IJC including a piezoelectric element, a method of detecting faulty IJCs, the method comprising the steps of:

connecting a maintenance drive circuit to the piezoelectric element through a selecting circuit, driving the piezoelectric element with an input voltage signal generated by the maintenance drive circuit; and sensing a phase difference between said input voltage signal and a current through said piezoelectric element resulting from said input voltage signal, so as to detect faulty ink jet channels.

12. The method of claim 11, wherein said driving comprises driving said piezoelectric element through an impedance.

13. The method as defined in claim 11, wherein said sensing comprises sensing voltage levels on both sides of an impedance.

14. The method as defined in claim 11, additionally comprising comparing said phase difference to a phase difference present when said piezoelectric element is functioning properly.

15. A method of detecting a faulty piezoelectrically actuated ink ejector in an ink jet printer comprising:

actuating said ink sector with an electrical signal generated by a maintenance drive circuit;

analyzing a frequency dependent impedance of said ink ejector simultaneously while performing the actuating of said ink: ejector with said electrical signal; and comparing said frequency dependent impedance with a frequency dependent impedance expected for a properly functioning ink ejector.

16. The method of claim 15, wherein said actuating comprises applying an electrical signal having an approximately constant frequency.

17. The method of claim 15, wherein said actuating comprises applying a voltage signal through a resistor to said piezoelectrically actuated ink ejector.

18. The method of claim 17, wherein said analyzing comprises monitoring a voltage developed across said piezoelectrically actuated ink ejector during said actuating.

19. A fault detection circuit for a piezoelectric ink jet printer comprising:

a driver circuit coupled to at least one piezoelectrically actuated ink ejector for applying a test signal to said at least one piezoelectrically actuated ink ejector;

a pre-processing circuit for monitoring, processing, and digitizing a response of said at least one piezoelectrically actuated ink ejector to said test signal, while said test signal is being applied; and digital signal processing means for receiving an output from said pre-processing circuit and for analyzing a frequency dependent impedance of said at least one piezoelectrically actuated ink ejector.

20. The circuit of claim 19, additionally comprising a memory means coupled to said signal processing means for storing information indicative of an impedance expected for a properly functioning piezoelectrically actuated ink ejector.

21. An ink jet printer comprising:

a plurality of ink ejection channels;

a test circuit for actuating each of said plurality of ink ejection channels so as to test said plurality of ink ejection channels for faults;

a digital signal processing circuit having a first input coupled to said test circuit for receiving test data while said test circuit is applied to one of said ink ejection channels during an ink ejection channel test process, and a second input coupled to receive print data during an ink jet printing process.

22. The ink jet printer of claim 21, wherein said test circuit is coupled to said digital signal processing circuit through pre-processor.

23. The ink jet printer of claim 22, wherein said pre-processor comprises an analog to digital converter.

24. A method of detecting faults in a piezoelectric ink jet print head comprising:

actuating at least one ink jet channel in said piezoelectric ink jet print head with a test circuit;

collecting test data indicative of the operation of said ink jet channel simultaneously with said actuating;

analyzing a response of said at least one ink jet channel with a digital signal processing circuit so as to detect faulty operation of said ink jet channel;

processing print data with said digital signal processing circuit;

controlling ink ejection from said piezoelectric print head with said digital signal processing circuit in accordance with said print data and in accordance with a result of said analyzing.

* * * * *